United States Patent [19]

Tytko

[11] 4,184,944

[45] Jan. 22, 1980

[54] ROTARY SCREEN APPLIANCE

[76] Inventor: Jean Tytko, 15, rue de Bourgogne, Tremblay-les-Gonesses, France, 93410

[21] Appl. No.: 791,142

[22] Filed: Apr. 26, 1977

[30] Foreign Application Priority Data

Apr. 27, 1976 [FR] France ..... 76 12477

[51] Int. Cl.[2] ..... B07B 1/24; B07B 1/54

[52] U.S. Cl. ..... 209/288; 209/382; 209/407; 209/413

[58] Field of Search ..... 209/288, 379, 381, 382, 209/322, 403–407, 412–414

[56] References Cited

U.S. PATENT DOCUMENTS

| | | | |
|---|---|---|---|
| 928,965 | 7/1909 | Hanna | 209/369 |
| 1,756,835 | 4/1930 | Sackett | 209/382 |
| 3,002,623 | 10/1961 | Fontaine | 209/288 |
| 3,208,593 | 9/1965 | Dietert | 209/288 |
| 3,835,955 | 9/1974 | Harkness | 209/310 |

FOREIGN PATENT DOCUMENTS 2177571 of 1973 France.

*Primary Examiner*—Frank W. Lutter
*Assistant Examiner*—Jon E. Hokanson
*Attorney, Agent, or Firm*—Browdy and Neimark

[57] ABSTRACT

A rotary screen appliance for the sifting of sand at a construction site is fittable directly to the mouth of a motorized driving device such as a cement mixer. A dismantable screen cage is connected to an armature preferably having three guide arms. A fastening portion is slidably attached to each guide arm and extends at an acute angle therefrom such that the fastening portions may engage the mouth of a cement mixer and thereby lock the screen cage thereto. Rotation of the cement mixer causes rotation of the screen cage. A device for rapping on the screen cage and thereby shaking it as it rotates is also provided.

8 Claims, 22 Drawing Figures

FIG. 7
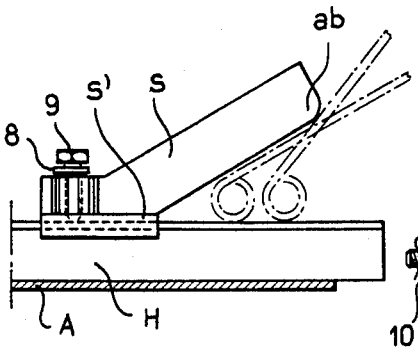
FIG. 8
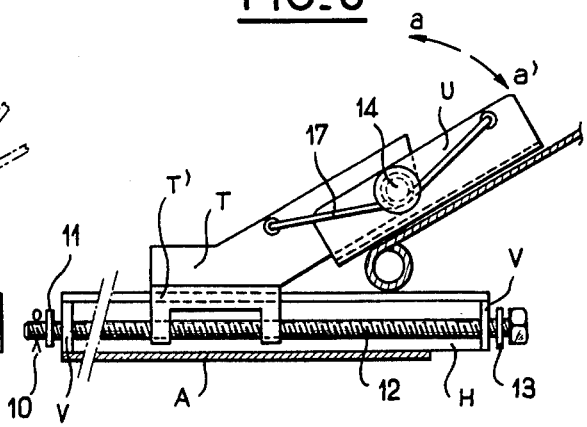
FIG. 9
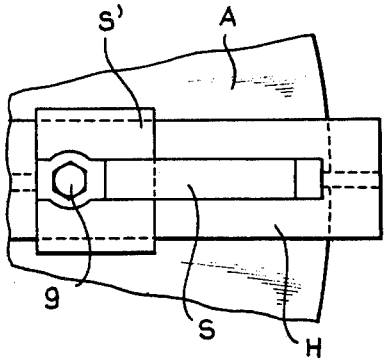
FIG. 10
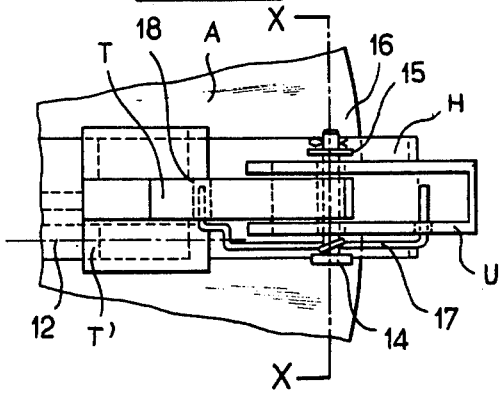
FIG. 11 COUPE X-X
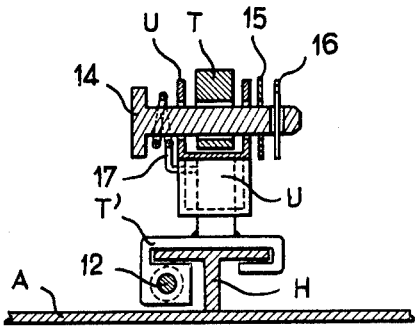
FIG. 12
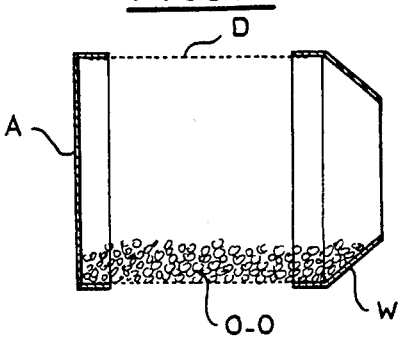

ROTARY SCREEN APPLIANCE

The present invention deals with a new rotary appliance intended for screening various dry or wet materials such as sand, soil, granular substances and the like, the apparatus being adaptable to different means of rotation, and particularly to the openings or mouths of concrete mixers.

A rotary screen is known in the prior art, which includes a screen cage of any shape (for example, polygonal) and a head equipped with adjustable means of fastening capable of being adapted to a driving member or device such as especially a concrete mixer, that is to say, the rotary appliance customarily employed on construction sites for the manufacture of small amounts of concrete to be used extemporaneously (French Pat. No. 72.11197 of Mar. 30, 1972 in the name of Jean TYTKO). This screen confers real progress with respect to hand screens and screen-concrete mixer and "drum"-concrete mixer units previously known. Maintenance of it is, however, difficult and costly because the main members are in one piece; furthermore, the bulk is important at times of handling and transport of the appliance.

The present invention deals with a screen appliance based on the same principle but exhibiting significant improvements which confer characteristics which significantly improve the qualities of handling, performance, safety and noise suppression. In particular, the new improved screen is rendered totally dismantlable thanks to the presence of a basic frame onto which in fixed or movable fashion the various members to be assembled come to be fitted. The appliance offers amongst other advantages particular qualities for handling, storage, shipment and replacement of worn or defective parts.

In accordance with a main characteristic of the present invention, a basic frame of profiled cross-section receives on one side, in fixed or movable fashion, the fastenings suitable for coupling it to different driving or rotary means. On the other side is provided, in fixed or movable fashion, a head and a screen cage or a cage equipped with its own head, these having a cylindrical, square, polygonal, convex or concave shape, which it drives in their motions of rotation.

Amongst other advantages, the profiled-section basic frame, depending upon the strength constituents of the materials, offers optimum qualities of rigidity for minimum weight; moreover, the head may be of lighter design and become an interchangeable part like the other constituents of the appliance.

Undeniably, existing concrete mixers exhibit throat and mouth rim shapes which differ substantially from one type to another. Because of this, difficulty arises in many cases, whilst ensuring satisfactory safety conditions, of successively coupling the screen appliance to different types of concrete mixer or other rotary means of the same species, without providing multiple accessories for adaptations. Such accessories are sources of complications both for manufacture and for use.

In accordance with another characteristic of the present invention, the security of successive couplings of the screen appliances to different types of concrete mixers or other rotary means of like configuration is automatically ensured by adjustable fastenings, the portion of which coming into contact with the rotary means being tilted towards its support, making with it an acute angle; in addition, these fastenings may be equipped with devices intended to improve their contact with the rotary means to which they come to be applied.

In accordance with another characteristic of the present invention, an adjustable system of automatic control of the fastenings enables the screen appliance to be coupled or uncoupled in one motion successively to various rotary means, this holding for a wide field of diameters with satisfactory safety conditions.

It is obvious that the fastenings of the screen appliances engage more or less on the rotary means along the shape of its rim. Since the rims of the rotary means have different shapes, it is difficult at the first shot to position the fastenings on the screen appliance at the appropriate position.

In order to make easier these operations of adjustment of the fastenings correctly on the screen appliances, in accordance with another characteristic of the present invention, a device is provided which, reproducing the support fastenings assembly of the screening appliance brought to one diametral plane, consists essentially of a graduated measure provided with two fastenings similar to those of the screen appliance. The fasteners are attached to the measure so that their ends are aligned in a common plane. One of the fastenings serves as the starting point of its graduation, and the other, sliding on the measure, serves as vernier.

In order to be used together, the scale of graduation of the measure will be equal to double that of a concentric marking carried out on the head and or on the supports for the fastenings of the screen appliance.

Thus, in putting the device in position diametrically on the rotary means to be employed, the fixed fastening is applied to one of the sides and the other is brought against the opposite side; it is then sufficient to read from the measure at what corresponding point on the appliance the fastenings on their support will have to be positioned.

Indubitably, inopportune flow of matter in the course of screening is the cause of superfluous manipulations and the source of lower output. In order to avoid it one is led to raise the mouth of the screen cage above the horizontal, which in many cases makes it compulsory to perform tiresome levelling of the rotary means and does not solve the loss of output. That is, with the screen cage so raised, the matter to be screened tends to accumulate towards the head, thus reducing the effective working surface.

In order to alleviate this problem, in accordance with another characteristic of the present invention, a frustoconical rim is fitted to the opening from the screen cage.

Thus, this rim fitted to the opening of the screen cage on the one hand enables the layer of matter to be screened to be retained inside it and on the other hand, thanks to its slope towards the outside, facilitates the discharge of the residues from screening.

For applicances equipped with a system which shakes their cage it is found that the best output is obtained when the cages have a certain radial elasticity.

Another characteristic of the present invention consists in the frustoconical rims being so constructed as to preserve the elasticity of the screen cages; in addition, it should be observed that longitudinal assemblies of screen cages enable these to be easily given the radial elasticity desired.

In screen appliances composed of a head distinct from the cage it may happen that with the vibrations inherent in the appliance in operation an untoward flow of particles larger than those desired occurs between the two members, these particles then getting annoyingly mixed with the screened products.

In accordance with another characteristic of the present invention, a joint having elastic properties is interposed between the head and the screen cage, so achieving sealing between the two members whilst preserving the elasticity of the screen cages. In addition it contributes to the suppression of noise in the appliance. Without departing from the scope of the present invention this joint may be fitted by any means, device or the like, either to the head or to the screen cage or both—and these two may themselves be designed to receive it in a fixed or movable manner.

Another characteristic of the present invention consists in providing the constituent parts of dismantlable screen cages with longitudinal flanges which are the basis of various assemblies of which on the one hand they facilitate the execution and to which on the other hand, depending upon the different profiles that they may have, they impart particular qualities.

It appears that optimum efficiency of the systems intended to shake the screen cages is obtained when the action of the latter is produced near the center of the length of the screen cages which they are shaking. Hence, in order to bring these systems to act at the favorable spot, recourse is had to supports for these systems which are sufficiently long. This makes reinforced supports essential; similarly, the end must be reinforced at the place where these supports are attached and all the more so the longer the supports, whence considerable increase in weight of the appliance with the consequences which that brings about.

In accordance with another characteristic of the present invention, for a more rational and more advantageous execution, the means intended for shaking the screen cages are attached directly near to or in the plane of their action onto the screen cages or onto the longitudinal parts of the driving members inside or outside the screen cage.

In accordance with another characteristic of the present invention, a device is provided which enables the shaker systems to be fitted detachably to the screen cages and/or to the members driving these cages on their longitudinal parts, that is, either inside or outside the cages. In addition, this device may easily be located in or near the plane of action of these skaker systems. Thus, the latter may be employed successively on different screen cages.

Without departing from the scope of the present invention, when the shaker means will lie outside the screen cages any means of protection such as a casing or the like may be employed or adapted to the appliances and in any way.

In accordance with another characteristic of the present invention, the system intended for shaking the screen cages includes weights as the shaker means and in addition a rapper device which self-cleans the system by making the particles fall which might stick onto them, particularly by an acute angle which these rappers form with the rods to which they are attached, being an angle which transforms the rappers into levers acting upon the rods with the cooperation of the elasticity of the latter when the weights come and rap them. Without departing from the scope of the present invention this system may be fitted in a fixed or removable way to the inside or outside of the screen cages, it being understood that the system may equally well be fitted to appliances including a member driving interchangeable screen cages.

In order to reduce the inconveniences due to noise inherent in any appliance in motion, in accordance with another characteristic of the present invention, the parts which clash and or those which have an alternating movement between them will be made of or fitted with a noise-suppressing material such as, for non-restrictive examples: rubber, leather, felt, elastomer, etc., reinforced or not, sufficiently hard and having good qualities of resilience. Of course these materials may equally well be interposed in the form of washers or the like without thereby departing from the scope of the present invention, just as any system, device, or means may be employed for attaching or interposing these sound-suppressing materials, as well as in any ways or manners judged useful or necessary, which means may be such as those well-known by gluing, coating, vulcanizing, molding, screwing, crimping or suitable seatings.

The descriptions and the drawings concerning the present invention are given here only by way of indication and are in no way restrictive as to the shapes of the parts, materials employed, devices, methods or means employed.

The drawings attached will enable the characteristics of the invention to be better understood.

Figure 6:
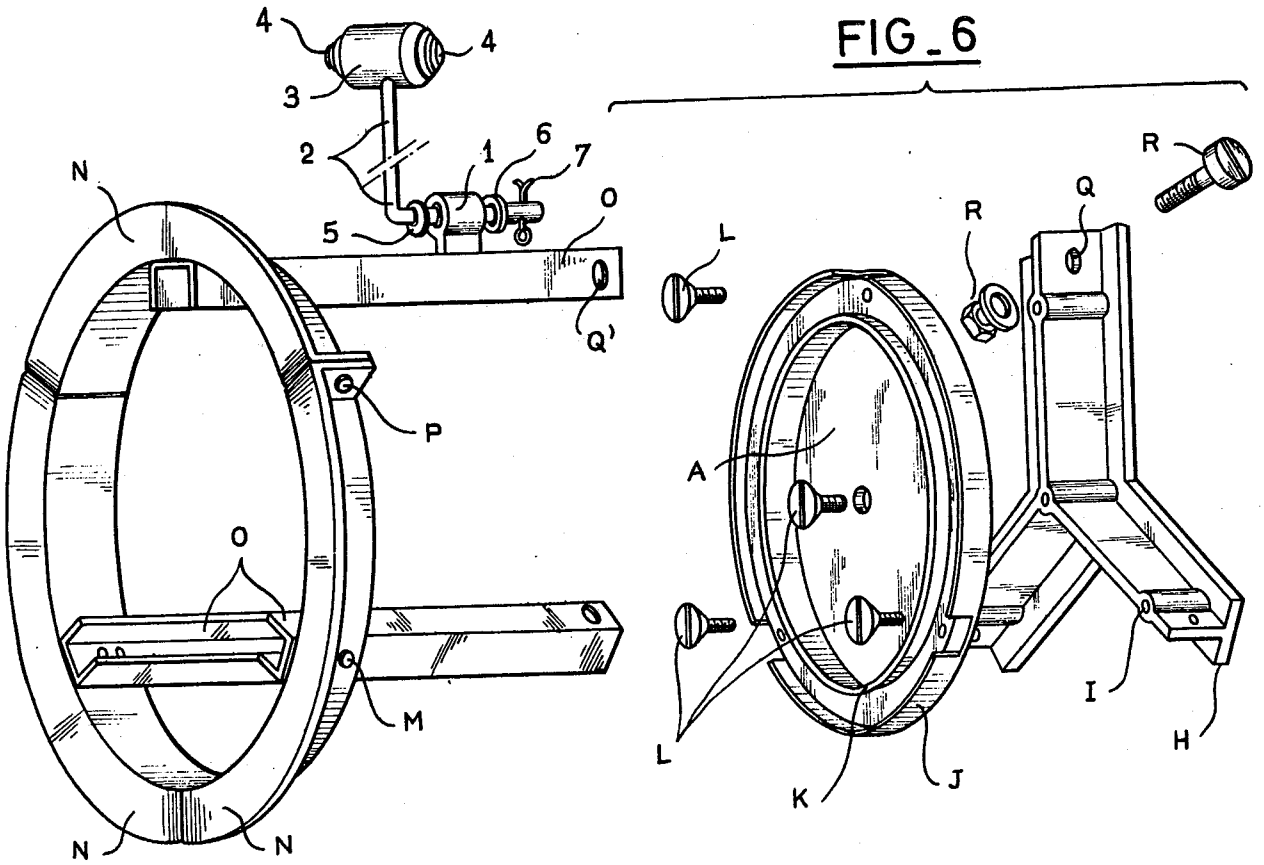

FIG. 6 represents a type of basic frame with a detachable head equipped with an elastic joint, a dismantlable assembly of slides provided with a frontal crown and on one of the slides a means intended for shaking the screen cages located nearest to its plane of action, the other two slides being equipped in the same fashion. These parts, once assembled form a type of driving appliance for interchangeable screen cages, easily dismantlable, which on the other side of the basic frame is provided with suitable fastenings and is adapted to the rotary means.

FIG. 7 represents in elevation a type of fastening which by the slope of the portion of it coming into contact with the rotary means which in turn has a sloping profile, automatically ensures the security of the coupling.

FIG. 8 represents in elevation a fastening of the same species as that in FIG. 7 but including a device with screws for the control of its movement on its support and screwing to lock it onto the rotary means; moreover it is provided at its end ab (FIG. 7) with a detachable device which mates automatically with the angle of the rotary means when being applied against it, which ensures better contact between the two.

FIG. 9 represents a plan view of FIG. 7.

FIG. 10 represents a plan view of FIG. 8.

FIG. 11 represents a section along the line X—X in FIG. 10.

FIG. 12 represents a diagrammatic longitudinal section of an appliance the opening of which from the screen cage is provided with a frustoconical rim, the appliance being in the position for screening.

Figure 13:
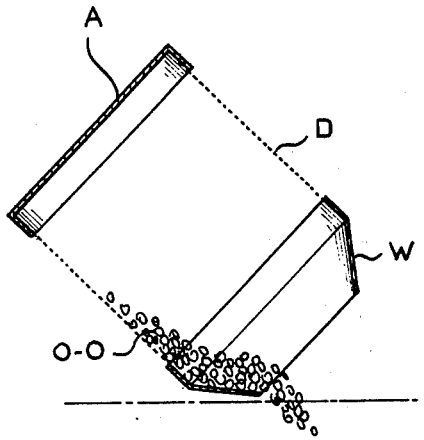

FIG. 13 represents in the same fashion as FIG. 12 the appliance in the position for rejecting residues from screening.

Figure 14:
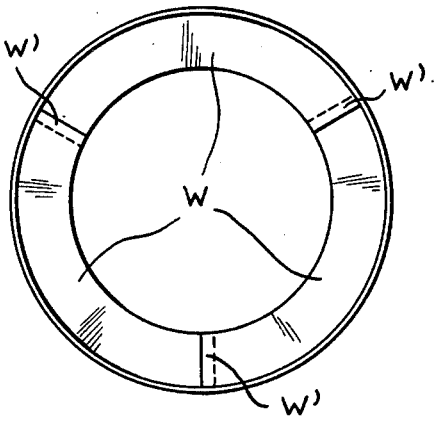

FIG. 14 represents a frustoconical rim seen from the end, in a style in which it has regard for the elasticity of the cage equipped with it.

Figure 15:
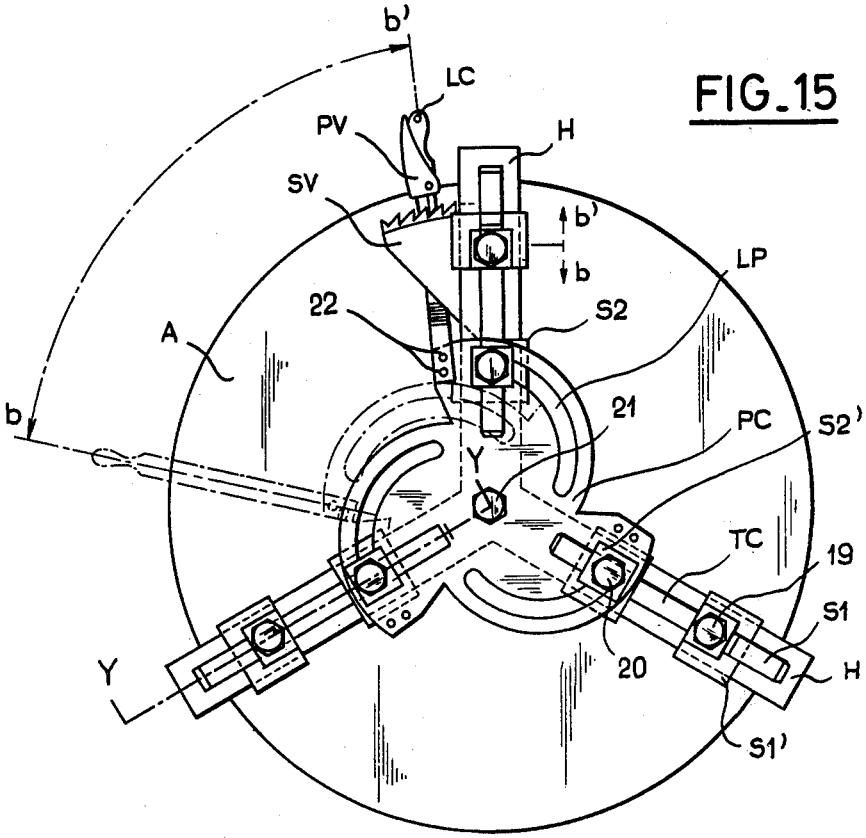

FIG. 15 represents a system of control and its devices for the fastening of appliances, which enables the latter to be coupled or uncoupled in a single motion to or from their rotary means.

Figure 16:
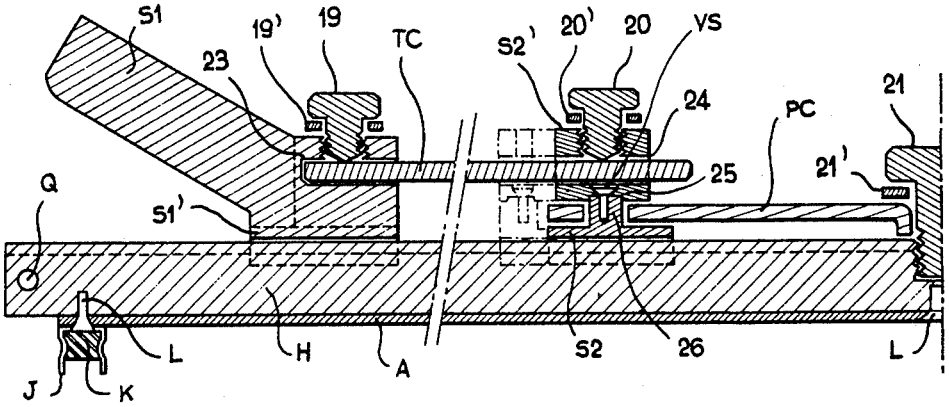

FIG. 16 represents a section along the line Y—Y in FIG. 15.

Figure 17:
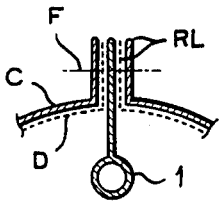
Figure 18:
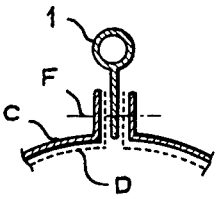
Figure 19:
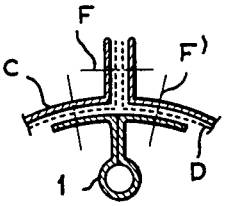

FIGS. 17–18 and 19 represent a partial diagrammatic section perpendicular to the axis of rotation of the screen cages, of a device enabling the screen cages to be equipped detachably with systems intended for shaking them, the latter being attached near to or in the plane of their action at the spot required.

Figure 20:
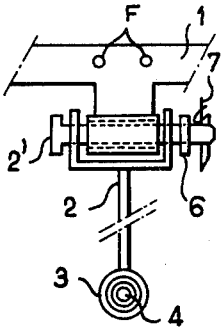

FIG. 20 represents in a plane perpendicular to the previous ones the device in elevation, equipped with a swinging hammer by means of a spindle 2' fastened by a washer 6 and a split-pin or cotter 7.

Figure 21:
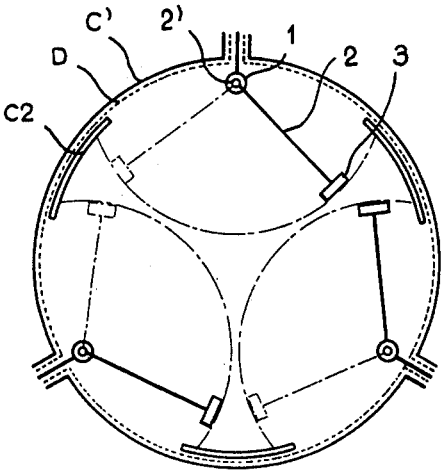

FIG. 21 represents diagrammatically the section of an appliance the screen cage of which is provided with swinging hammers intended for shaking it, having their points of attachment to the screen cage located in the plane of their actions by the device indicated in FIGS. 17, 18, 19 and 20.

Figure 22:
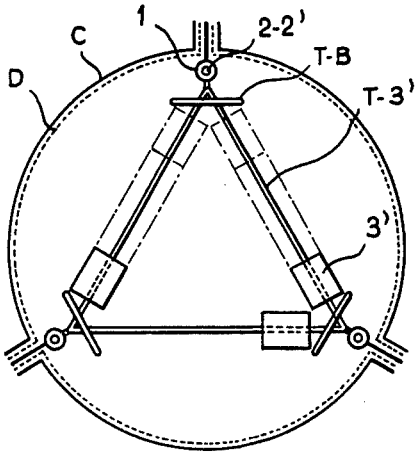

FIG. 22, like FIG. 21, represents an appliance the screen cage of which is equipped in the same fashion as the appliance as FIG. 21, but with a shaker system with weights.

Figure 1:
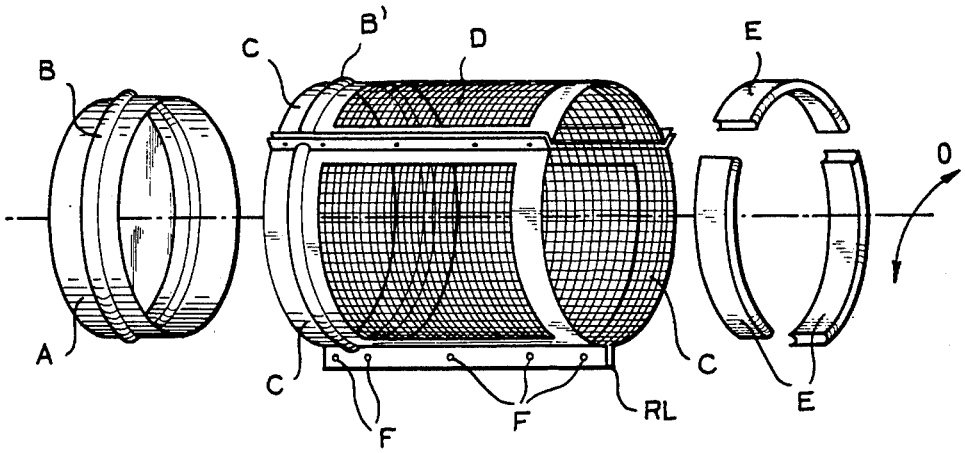
FIG. 1 represents an appliance in accordance with the present invention, partially dismantled, in one of its simplest styles, consisting of separate parts.

The appliance represented in FIG. 1 in accordance with the present invention is composed of a number of parts so as to be easily dismantlable, one being a flanged head A (this head may in turn be divided into a number of parts) which on one side will be provided with any means intended for coupling it to the rotary means, which latter may in turn be equipped to receive it, and on the other side will receive a screen cage which will enclose it. This screen cage, divided in its turn into a number of parts assembled in an easily dismantlable manner, comprises three frames C which with three screen parts D are joined and fastened together by bolts, nuts and washers F; the parts E fitted onto the end of the cage hold the parts D against the frames C by trapping the two parts together.

Of course without departing from the scope of the present invention, the screen cages may include any number of parts, just as, if the screen parts D are sufficiently rigid, the frames C and the parts E may be dispensed with. The rim of the head A includes a rib B onto which the rib B' on the parts C of the screen cage get fitted; thus at the time of assembly the screen cage gets tightened round the rim of the head A; the ribs B and B' fitting together prevent any sliding of the two assembled members between them, whilst contributing to the rigidity of each. The end of the parts D next to the head is trapped between the rim of the head A and the end of the screen cage. Without departing from the scope of the present invention any other means of assembly may be adopted.

Figure 2:
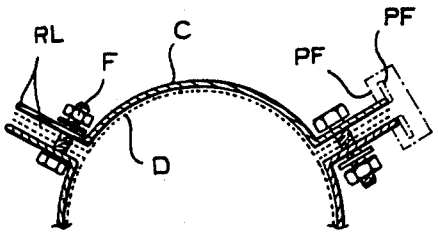
FIGS. 2, 3, 4 and 5 represent diagrammatically a section perpendicular to the axis of rotation of the screen cages, of assemblies including longitudinal flanges, which may be adopted among others for producing dismantlable cages.
Figure 3:
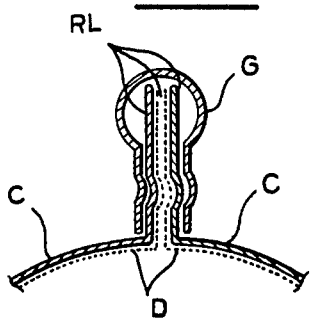
Figure 4:
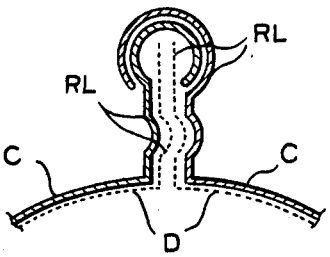

The screen parts D shaped to mate with the inside of the parts C have their longitudinal flanges RL clamped between those of the parts C with the cooperation of the fastenings F. The longitudinal flanges RL with which in accordance with the invention the parts D and C are equipped, seen in FIGS. 1, 2, 3, 4, 5, 17, 18 and 19, whilst enabling easy assembly of the constituent portions of the screen cage, contribute to their rigidity in the direction of their length, and consequently of that of the screen cages, whilst enabling the latter to be given a radial elasticity. Longitudinal assemblies are achieved which are more or less flexible either by blocking more or less the fastenings F or by interposing between the flanges of the screen parts D an elastic strip or else by producing articulated assemblies or of course by any other means. In addition these longitudinal flanges RL serve for driving the cages in appliances including a member which on one side is fitted to the rotary means and on the other receives a cage which it drives. That is, when these flanges have a shape such that as seen in FIGS. 2–3 and 4, they may be inserted in the slides O of the driving member (FIG. 6), or conversely with a shape such as that in FIG. 5 may act as slides for the bars O' (FIG. 5) of the driving members. These flanges RL as may be seen from FIGS. 3–4 and 5 may include besides the fastenings F ribs, bosses or other devices along their length, which being fitted together at assembly will ensure their stability by preventing sliding of the elements on one another.

Figure 5:
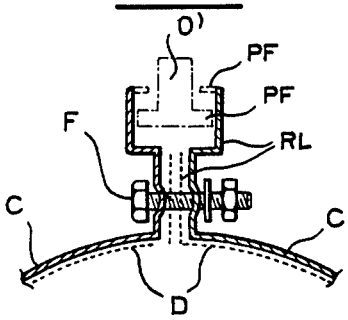

The longitudinal flanges of the screen cages RL conjointly with the slides O or bars O' of the driving member will in accordance with the invention have a profile PF as indicated in dotted line in FIGS. 2 and 5, which while enabling radial motions of the screen cage limits their amplitude. Thus these profiles PF whilst adding a counter-shock effect to that of the means shaking the screen cage prohibits any disengagement of the two members along their length, thus enabling screen cages to be employed having high radial elasticity.

Of course without departing from the scope of the present invention each part may include, fixed to it, the male or female part of the fastenings F or others of any nature; similarly the edges of the parts D may be reinforced by any means such, for example, as a welded or crimped metal flange, a rubber flange or the like. Furthermore the parts including longitudinal flanges may be used for the production of screen cages of various shapes and be locked by any systems, devices or means, known or unknown.

It should likewise be observed that without departing from the scope of the present invention all the screen cages and all the heads intended for equipping the screening appliances in its different styles, may have a cylindrical, square, polygonal, concave or convex shape which is inscribed within a circumference.

The style of assembly as FIG. 3 includes in accordance with the invention a closure slide G. Of course fastenings F or others may be united with it.

An articulated assembly in accordance with the invention (FIG. 4) clamps the screen flanges D or forms part of them when they are sufficiently rigid. For closure of the cage the last assembly may be either fastened by the fastenings F or by any other system of locking, such as with a slide G or the like. When the screen part D is not sufficiently rigid to act itself as the assembly of this type it will be necessary to provide a longitudinal packing piece in order to copensate for the differences in thickness between the screen parts D of thickness less than that for which the assembly will have been designed.

An assembly profile in accordance with the invention (FIG. 5) enables the cages to act as guides for the bars O' (FIG. 5) of the driving member of appliances receiving interchangeable cages.

It is to be observed that the slides G as FIG. 3 or the top of the hinges as FIG. 4 may be provided with an upper profile of the same nature to act as guides as above.

Of course the slides G, the hinges or the guides may be of the same length as the longitudinal flanges which are equipped with them, or be divided up.

In accordance with one embodiment an appliance of the invention includes a frame H—see FIG. 6—onto which are fitted, preferably in an easily dismantlable fashion, on the one side any means intended for coupling it to various rotary means, amongst which means are those which are objects of the present invention such as in FIGS. 7, 8, 9, 10, 11, 15 and 16; on the other side there are fitted a head A, attached to the frame H by the screws L which are screwed into tapped holes I in the frame H, and guides O for receiving and driving the different kinds of screen cages. These guides O are fitted outside the periphery of the head A onto the arms of the frame H. One or two holes Q drilled in the inner flange of the arms of the frame H and conjointly holes Q' in the sidefaces at one end of the guides O enable fastenings R to pass through.

On the outer periphery at the other end of the guides O a crown formed by the parts N, these being assembled by fastenings P, is fitted onto the guides O and fastened by the fastenings M.

Without departing from the scope of the present invention, any system, device or means may be employed for stability of of the assemblies. In addition, the basic frame H, here shown as a T-section, may equally well have any other section and be obtained in any way or by any means such as molding, various assemblies, various sections or the like. Similarly the basic frame may include any systems, devices or means intended for fitting a screen cage of any shape, cylindrical, square, polygonal, etc., equipped with a head or as previously, with a distinct head.

FIGS. 7, 8, 9, 10 and 11 represent fastenings, the portions S and T of which in accordance with the invention slope towards the head A of the appliance or of the guide H, forming an acute angle with these latter. Thus at the time of putting them in position these portions S and T of the fastenings enter the rotary means 50 and get trapped in it. As shown diagrammatically in dotted line in FIG. 7 it may be seen that the end ab of the fastening S or T gets automatically trapped in the rotary means 50 from the instant when the inside of the latter forms a more or less acute angle with the guide H. Thus the safety of the couplings is automatically ensured with rotary means having a sloping profile; these fastenings may be orientated either towards the inside (center of the appliance) or towards the outside along the profile of the rotary means (hollow or solid). In addition the shape of the outer rim of the rotary means no longer poses problems of ensuring the safety of couplings such as with the mouths of concrete mixers as may be the case with systems having external countertightening. It is to be observed that the end ab of the fastenings S and T may be provided with any foot, fixed or movable, fitted by any means, for ensuring better contact with the rotary means or if necessary acting as a liner. FOr use it is necessary to equip the appliances with at least two fastenings of type S and one of type T.

The former of type S (FIG. 7) includes a base S' having a shape suitable for being able to slide along guides of the type H or the like and a means 9 or the like, suitable for the type of guide the profile of which would be different, for locking it at the required place on it. A washer 8 of fan type or the like prevents untoward slackening of the bolt 9.

The second one of the type T—(FIG. 8)—likewise includes a base T' of the same shape as above, having in addition a tapped portion to receive the screw 12 which controls its movement along the guide H and locking of it in the rotary means. Two small plates V attached to the guide H are drilled with holes through which passes the screw 12. These plates V act as support and abutment to the screw 12. The screw 12 at its outer end includes a head for controlling it by a removable spanner; at the other end is provided an abutment means, here constituted by a splitpin 10 and a washer 11. A washer 13 of fan type or the like ensures locking of the screw 12.

A device in accordance with the invention, as seen in FIGS. 8–10 and 11 may be fitted to the fastenings S and T in order to ensure better contact with the rotary means. It consists of a tilting shoe U at the end ab of the fastenings S or T on a splindle with a head 14 which passes through the holes arranged for this purpose in the sides of U and the end ab of S or T. A washer 15 and a split-pin or cotter 16 acts as a stop for the spindle 14. A return spring 17 brings the shoe back from the position a' when it is locked by the rotary means 50, to the position a in the rest position. Thus while facilitating the putting of the appliance in place on the rotary means it avoids the shoes being in a position in the way. Here the return spring 17 has one end engaging in a hole 18 arranged in the fastenings S or T, is retained by the headed spindle 14 and its other end engages in a hole arranged in the side of the shoe V as may be seen in FIGS. 8–10 and 11.

It is quite obvious that without departing from the scope of the present invention any other system of return or positioning of the shoe V may be employed and the shoe V may have a shape adapted to particular cases.

In FIGS. 12 and 13 the opening from a screen cage D is provided in accordance with the invention with a frustoconical rim W. It appears closely in FIG. 12 that a layer of matter to be screen O—O is retained thanks to the rim W. This is valid for screen appliances designed to be fitted to rotary means the axis of rotation of which remains horizontal. That is, as a function of the screening, the frustoconical rim maintains a layer of matter to be screened as previously; as a function of the rejection of the residues from screening, the slope of the frustoconical rim offers these an outlet incline. It is quite obvious that a rim with a right angle towards the inside of the screen cage, even if it enabled a layer of matter to be screened to be maintained, is particularly in the way of discharge of the residues from screening.

In addition the screen cages equipped with this frustoconical rim involve no supplementary manipulation for screening operations.

Without departing from the scope of the present invention this frustoconical rim may be either the prolongation of the screen parts D or form part of the elements E and or be fitted by any means onto the screen cages or the parts constituting them.

In FIG. 14 may be seen a simple means of producing a frustoconical rim W in accordance with the invention, which has regard for the elasticity of the screen cages which are equipped with it. It is sufficient to produce this rim W in a number of parts which overlap at W'. Without departing from the scope of the present invention the frustoconical rim W in order to preserve the elasticity of the screen cages may be made of a flexible material, reinforced or not, or have flexible connections between its different portions. Of course it may equally well be fitted by any means to the screen cages.

FIGS. 15 and 16 show in accordance with the invention another system and device for control of the fastenings for coupling or uncoupling the screen appliance with rotary means of different diameters such as concrete-mixer mouths or other rotary means of the same shape with a minimum of accessories.

The system comprises a plate PC of helicoidal or spiral shape, which pivots about a pin 21; the latter, screwed into a tapped hole at the center of the guides H holds the plate PC without locking it; a flat washer 21' interposed between the head of the pin 21 and the plate PC facilitates movement of the latter.

The plate PC includes helicoidal or spiral slots LP in which are engaged the studs 26 which are integral with the bases S2 which slide on the guides H.

It may be seen in FIG. 15 that in moving the control lever LC attached to the plate PC from b' to b or vice versa the edges of the slots LP by way of the spindles 26 pull or push the bases S2 which as simultaneously moved along the guides H in the direction b'-b for uncoupling and conversely in the direction b-b' for coupling. It is obvious that the bases S2 might be in one piece with the fastenings S1 and so with a set of plates PC of different sizes a wide field of diameters of rotary means might be covered. But it is well known that on sites accessories easily get lost. In accordance with the invention, devices enable a wide field of diameters to be covered primarily by simple substitution of the control rods TC—FIGS. 15 and 16—of the fastenings. These rods TC may be made simply from ends of bar for concrete, which facilitates their replacement in the event of loss on site.

The studs 26, drilled and tapped at their centers will receive a part S2'—a kind of rod-clamp—including on the bottom of it a seating 25 intended to fit onto the top of the studs 26. A screw VS is used to attach S2' to 26. S2' includes a hole 24 through which slides the rod TC for control of the fastening S1. On the same axis as the hole for passing the screw VS through its base, S2' includes a tapped hole in its upper portion, perpendicular to and on the axis of the hole 24, intended for receiving the bolt 20. The diameter of this bolt will be larger than that of the head of the screw VS, this being in order to enable this screw VS to pass through at the time of assembly of the whole S2-S2'. The rod TC passing through the hole 24 in S2', once adjusted to a satisfactory distance, is locked by the bolt 20, the washer 20 of fan type or the like acting as a stop.

For a stronger construction S2 and S2' may be extended as indicated in dotted line in FIG. 16. The other end of the rod TC comes and seats itself in the blind hole 23 which the fastening S1 includes.

S1 includes on top a tapped hole perpendicular to and on the axis of the hole 23, intended for receiving the bolt 19 which serves to lock the rod TC, the washer 19' being like the washer 20'.

In use the control lever LC is put in its open position b—FIG. 15. The control rods TC are located abutting against the bottoms of the holes 23 in the fastenings S1, then locked by the bolts 19. Letting the fastening S1 slide along the guide H with the bolt 20 slack, the end of TC is made to pass through S2' by the hole 24. The rod TC should at a minimum come flush with the other side of S2'. Then the inside diameter of the passage through the opening in the rotary means onto which it is required to fit the screen appliance is measured and then, starting from the center of the appliance, the outer ends of the fastenings S1 are set at a distance slightly less than that of the opening in the rotary means. This is in order to be able to make the fastenings S1 pass inside the latter (into its opening). The bolts 20 are then slightly tightened so that a certain pressure on the fastenings S1 is necessary for the rods TC to slide in S2'. This being done for the three sets of fastenings, the appliance is put in place on the rotary means by introducing the fastenings S1 inside. The system is closed by bringing the control lever LC to the position b'. Because of this, during a first period the fastenings S1 come into contact with the inside of the rotary means; next, by forcing against this control lever LC the rods TC slide in the parts S2' until the control lever LC has arrive at its closed position b'. It is then sufficient to take the appliance out again after having brought the control lever LC back to its open position b and to tighten the bolts 20 to lock the rods TC, these being in their position in S2'. The appliance is then ready to be coupled to the rotary means.

As may be seen in FIG. 15 the control lever LC is equipped with a system PV which serves to lock it in its closed position b' on a toothed sector SV attached to the perpendicular portion at the bottom of the guide H. This system relates to the well known systems employed for the handbrakes of motorcars. Of course without departing from the scope of the present invention any other system, device or means may be adopted for equipping the appliances for this purpose. It is to be observed that the control lever LC will have to be brought back towards the head, at the nearest, or starting from its attachment 22 to the plate PC, this being in order to avoid the top edge of the guide H where the rotary means come to be applied. On the other hand the control plate PC with the slots LP will have to make the fastenings S1 move, hence S2 and S2', between the positions b and b', by a distance slightly greater than that lying between two perpendiculars dropped onto the guide H, the one passing through the outer end of S1, the other through the other end of S1'. Furthermore a control plate PC without slots LP may be used simply to push the parts S2 out and their return towards the center may be obtained by return springs attached at one end to S2-S2' and at the other to 21 or 21'.

It is also to be observed that for supplementary security the edge of the plate PC or the slots LP on the portion where the studs 26 lie in the closed position b' of the fastenings of the appliance onto the rotary means should be practically perpendicular to the radial axis of the guides H. This is in order to have a straightline thrust of the fastenings towards the pin 21 in order to avoid any couple effect of these on the plate PC which would tend to opening of the system.

FIGS. 6 and 16 represent a way of fastening the elastic joint K which in accordance with the invention is interposed between the head A and the screen cages which are fitted against it. Here the joint is held in a recess made of a channel section including ribs on the sides of it and attached to the head A.

FIGS. 17-18 and 19 represent diagrammatically in section a device in accordance with the invention which enables the screen cages themselves to be equipped in a movable fashion and at the required point, with means intended to shake them.

FIG. 20 shows this device seen in its longitudinal plane perpendicular to that as FIGS. 17–18 and 19. In addition this device 1 as represented in FIG. 6 may be attached at the required point by any means to the guides 0 or bars 0'—FIG. 5 of the driving member of the screen cages which it is intended to receive.

As may be seen, this device 1 consists of a small hollow cylinder including a foot for attaching it to the screen cage or to the parts 0 or 0' of the driving members. As may be seen in FIGS. 17 and 18 the foot for attachment of the device 1 may be inserted between the flanges of the screen cages and fastened by the fastenings F, and the device 1 may be located either inside or outside the cage.

In FIG. 19 is seen another way of attaching the device to the screen cages by way of its attachment foot in the form of a base attached by fasteners F'.

In FIG. 20 it is seen that the portion of the attachment foot of the device 1 intended to be attached to the screen cages may have the required length. It is obvious that it will have the same profile as that of the parts to which it will be fitted and attached.

FIGS. 6 and 20 represent a means by which the systems intended to shake the cage may be fitted to the device 1.

In the case of FIG. 6 the end of the arm 2 opposite from the hammer 3 forms a shaft which engages in the device 1 and includes on one side an abutment 5 and at the end of it on the other side of the device 1 a stop means—here consisting of a flat washer 6 and a split-pin or cotter 7. So the oscillations of the hammer 3 occur in a plane perpendicular to the axis of rotation of the cage, the hammer coming to strike it over a limited width which may easily be reinforced as may be seen in FIG. 21, on the outside of the screen part D by a strap C' or on the inside by a reinforcement C2 attached by any means.

In FIG. 20 is seen a means where the arm 2 of the hammer 3 is designed to be fitted to the device 1 by way of a pin 2' having at one end a head and at the other a washer 6 with a split-pin or cotter 7 acting as a stop.

Of course without departing from the scope of the present invention the device 1 may appear as the male portion receiving the female portion with which will be provided the means intended to shake the screen cage.

FIG. 22 shows diagrammatically a system with weights, in accordance with the invention, intended to shake the screen cages. It consists of rods T3' along which the weights 3' slide freely to come and strike the rappers TB. In order to be able to fit it successively to different screen cages the joined ends of the rods T3' include a device as previously described or the like. The weights 3' may if necessary be formed of two shells assembled by any means such as bolting, interlocking or the like. The rappers TB attached by suitable means to the rods 3' make an acute angle with them. Thus as may be seen in FIG. 22 the weights 3' come and strike the rappers at a certain distance from the rod T3' to which they are attached, which causes the rappers TB to become the arms of levers. Hence it may be seen that when the weights 3' come and strike the rappers TB they generate a torque effect which is reflected in the rods T3'. With the aid of the elasticity of the rods T3' the vibrations generated make the particles drop off, which may be sticking to the system.

In FIGS. 6 and 20 may be seen the hammers 3 provided with noise-suppressing buffers 4 in accordance with the invention. It is obvious that the weights 3', the rappers TB, the reinforcements C2 as well as the guides 0 or the longitudinal flanges RL of the screen cages may be provided with or constituted by a noise-suppressing material.

It is to be observed that in accordance with the invention in order to enable quick and easy exchange of the screen parts D, the screen cages or the parts C which constitute them conjointly with the screen parts D will be provided either with guides or slides enabling exchange of the screen parts D by simple sliding of them, or with fixed screws with wing-nuts, or conversely with tapped holes or with fixed bolts with wing-screws, enabling exchange of the screen parts D by simple screwing, or grooved studs employed conjointly with a spring stop device acting like circlips on spindles, enabling exchange of the screen parts D by simple pressure. Any other system, device or means may be employed for the same purpose without departing from the scope of the present invention.

I claim:

1. A rotary screen appliance having no motor and being fittable directly to a motorized driving device of the cement mixer type having an open mouth at one end, comprising:

a screen cage equipped with grids of suitable mesh and composed of a plurality of sections each having longitudinal flanges projecting out of the cage at which flanges the sections are assembled;

a head connected to one end of said screen cage and covering said end;

a frame, having at least two guide arms, connected to the side of said head opposite to the side covering the end of said screen cage;

fastening means, slidably connected to said guide arms, for entering the mouth of the driving device and coupling to the inside wall of the mouth such as to be supported thereby; and shaking means connected to said screen cage for shaking the screen cage as it rotates.

2. An appliance in accordance with claim 1 wherein said fastening means comprises:

a fastening portion slidably connected to each of said guide arms and extending therefrom at an acute angle thereto in the direction extending away from the axis of rotation of said screen cage; and locking means connected to each said fastening portion for releasably fixing said fastening portion to the respective guide arm thereof, whereby said fastening means is adjustable to adapt to various diameters of driving device mouths.

3. An appliance in accordance with claim 2 wherein said frame has at least three guide arms and wherein the fastening means on at least one of said guide arms further includes adjusting means causing said fastening portion to travel on the respective guide arm thereof.

4. An appliance in accordance with claim 3 wherein the fastening means attached to at least two of said guide arms include locking means comprising a locking screw and the fastening means attached to at least one other of said guide arms include said adjusting means and wherein said adjusting means comprises an endless adjusting screw disposed longitudinally with respect to the corresponding guide arm for selectively adjusting the longitudinal position of the respective fastening portion on the corresponding guide arm.

5. An appliance in accordance with claim 2, further including adjusting means for causing all of said fastening portions to travel on the respective guide arms thereof to thereby adjust the longitudinal position of each of said fastening portions on the respective guide arm thereof.

6. An appliance in accordance with claim 5, wherein said adjusting means comprises a plate, rotatable about a pivot fixed on the axis of rotation of said screen cage, said plate having guiding surfaces thereon for causing said fastening portions to move on the respective guide arms thereof as said plate rotates.

7. An appliance in accordance with claim 1 wherein said shaking means comprise a plurality of rods connected to the interior of said screen cage and traversing the interior of said screen cage in a plane substantially perpendicular to the axis of rotation of said cage when in use and a weight slidably disposed on each of said rods, and wherein said rods include rappers extending at an acute angle with respect to said rods proximally to the ends thereof in a manner such that said rappers act as stops to said weights, whereby rotation of said screen cage causes said weights to slide on said rods and rap against said rappers, thereby shaking said screen cage.

8. An appliance in accordance with claim 1 wherein said shaking means comprise hammers connected to the longitudinal flanges of said screen cage.

* * * * *